US009284027B1

(12) United States Patent
Kalke

(10) Patent No.: US 9,284,027 B1
(45) Date of Patent: Mar. 15, 2016

(54) BOAT WASH/RINSE SYSTEM

(71) Applicant: Gerhard G. Kalke, St. Petersburg, FL (US)

(72) Inventor: Gerhard G. Kalke, St. Petersburg, FL (US)

( * ) Notice: Subject to any disclaimer, the term of this patent is extended or adjusted under 35 U.S.C. 154(b) by 0 days.

(21) Appl. No.: 14/030,313

(22) Filed: Sep. 18, 2013

(51) Int. Cl.
*B63B 59/00* (2006.01)
*B63B 59/06* (2006.01)

(52) U.S. Cl.
CPC ..... *B63B 59/06* (2013.01)

(58) Field of Classification Search
USPC ..... 114/222
IPC ..... B63B 59/06,59/08
See application file for complete search history.

(56) References Cited

U.S. PATENT DOCUMENTS 5,040,485 A * 8/1991 Bailey et al. ..... 118/680
2008/0282956 A1* 11/2008 Morace ..... 114/222
2009/0266284 A1* 10/2009 Carmichael et al. ..... 114/222

* cited by examiner

*Primary Examiner* — Stephen Avila

(57) ABSTRACT

A lift receives a boat to be washed. The lift has a forward end, a rearward end, and an intermediate extent. The lift also has a first side with lift pilings and a second side with lift pilings. A pump feeds water from a water tank to a plurality of spray heads on each side of the lift. Controls at the lift pilings adjacent to the first side include a driver to move the boat between first and second positions and an optical sensor to sense the presence of the boat to be washed and to activate and inactivate the pump for the washing of the boat as it is moved.

4 Claims, 4 Drawing Sheets

FIG. 1
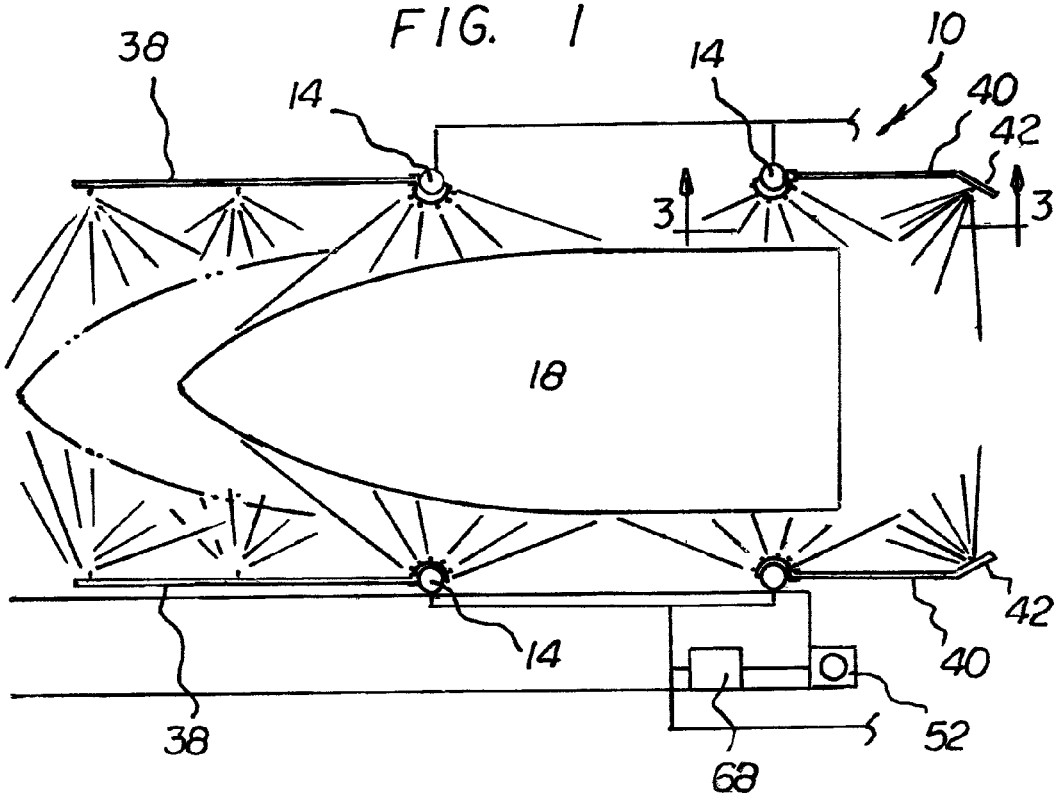
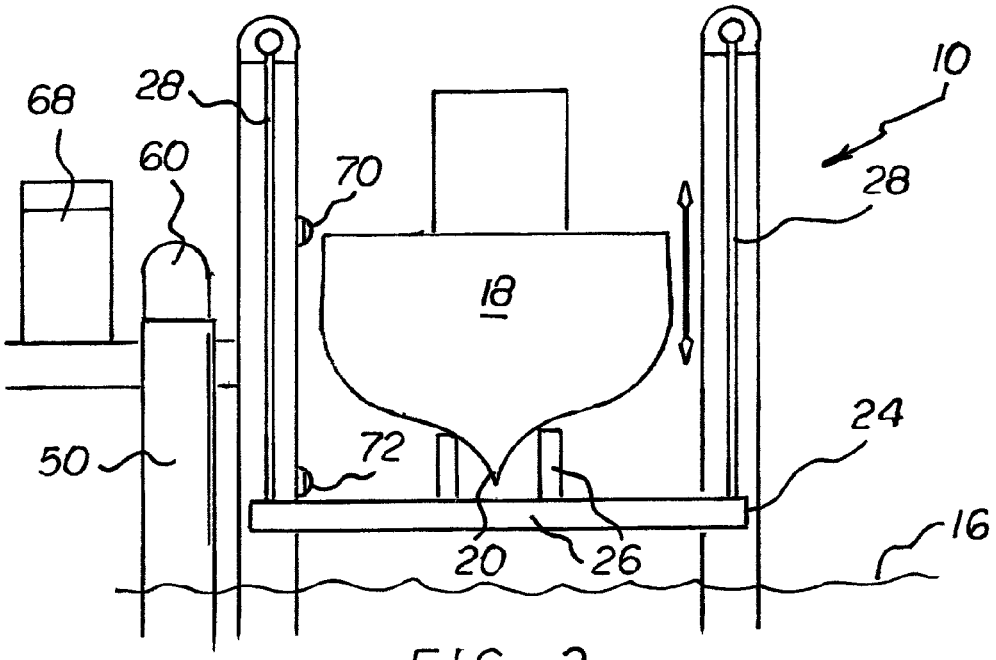
FIG. 2

BOAT WASH/RINSE SYSTEM

BACKGROUND OF THE INVENTION

Field of the Invention

The present invention relates to a boat wash/rinse system and more particularly pertains to washing and rinsing a boat while the boat is being raised and lowered, the washing and rinsing and the raising and lowering being done in a safe, ecological, convenient and economical manner.

SUMMARY OF THE INVENTION

In view of the foregoing disadvantages inherent in the known types of boat systems of known designs and configurations now present in the prior art, the present invention provides an improved boat wash/rinse system. As such, the general purpose of the present invention, which will be described subsequently in greater detail, is to provide a new and improved boat wash/rinse system and method which has all the advantages of the prior art and none of the disadvantages.

To attain this, the present invention essentially comprises a lift system. The lift receives a boat to be washed. The lift has a forward end, a rearward end, and an intermediate extent. The lift also has a first side and a second side.

A plurality of spray heads are provided on each side of the lift pilings.

A water tank has a pump. The pump feeds water from the water tank to the spray heads.

Controls are provided at the pilings adjacent to the first side. The controls include the driver and an optical sensor. The driver moves the boat. The optical sensor senses the presence of the boat to be washed and is adapted to activate and inactivate the pump for the washing of the boat as it moved.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved boat wash/rinse system which has all of the advantages of the prior art boat systems of known designs and configurations and none of the disadvantages.

It is another object of the present invention to provide a new and improved boat wash/rinse system which may be easily and efficiently manufactured and marketed.

It is a further object of the present invention to provide a new and improved boat wash/rinse system which is of durable and reliable constructions.

An even further object of the present invention is to provide a new and improved boat wash/rinse system which is susceptible of a low cost of manufacture with regard to both materials and labor, and which accordingly is then susceptible of low prices of sale to the consuming public, thereby making such boat wash/rinse system economically available to the buying public.

Lastly, another object of the present invention is to provide a boat wash/rinse system for washing and rinsing a boat while the boat is being raised and lowered, the washing and rinsing and the raising and lowering being done in a safe, ecological, convenient and economical manner.

These together with other objects of the invention, along with the various features of novelty which characterize the invention, are pointed out with particularity in the claims annexed to and forming a part of this disclosure.

For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a plan view of a boat wash/rinse system constructed in accordance with the principles of the present invention.

FIG. 2 is a rear elevational view of the system illustrated in FIG. 1.

The same reference numerals refer to the same parts throughout the various Figures.

DESCRIPTION OF THE PREFERRED EMBODIMENT

Figure 3:
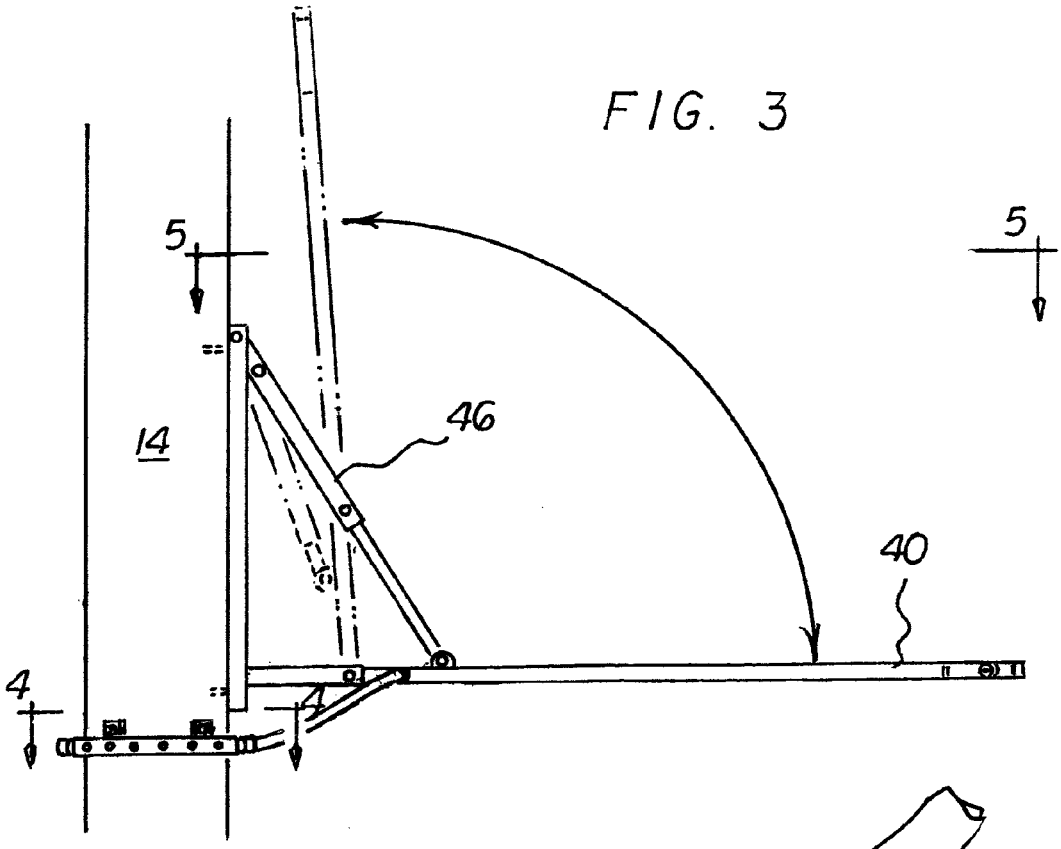
FIG. 3 is a cross sectional view taken along line 3-3 of FIG. 1.
Figure 4:
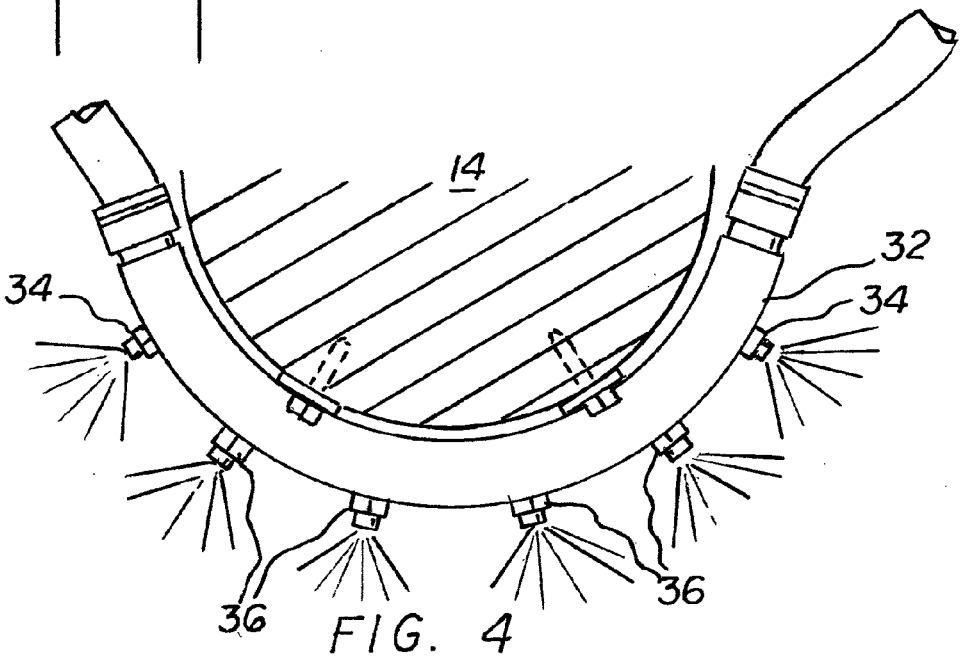
FIG. 4 is a cross sectional view taken along line 4-4 of FIG. 3.
Figure 5:
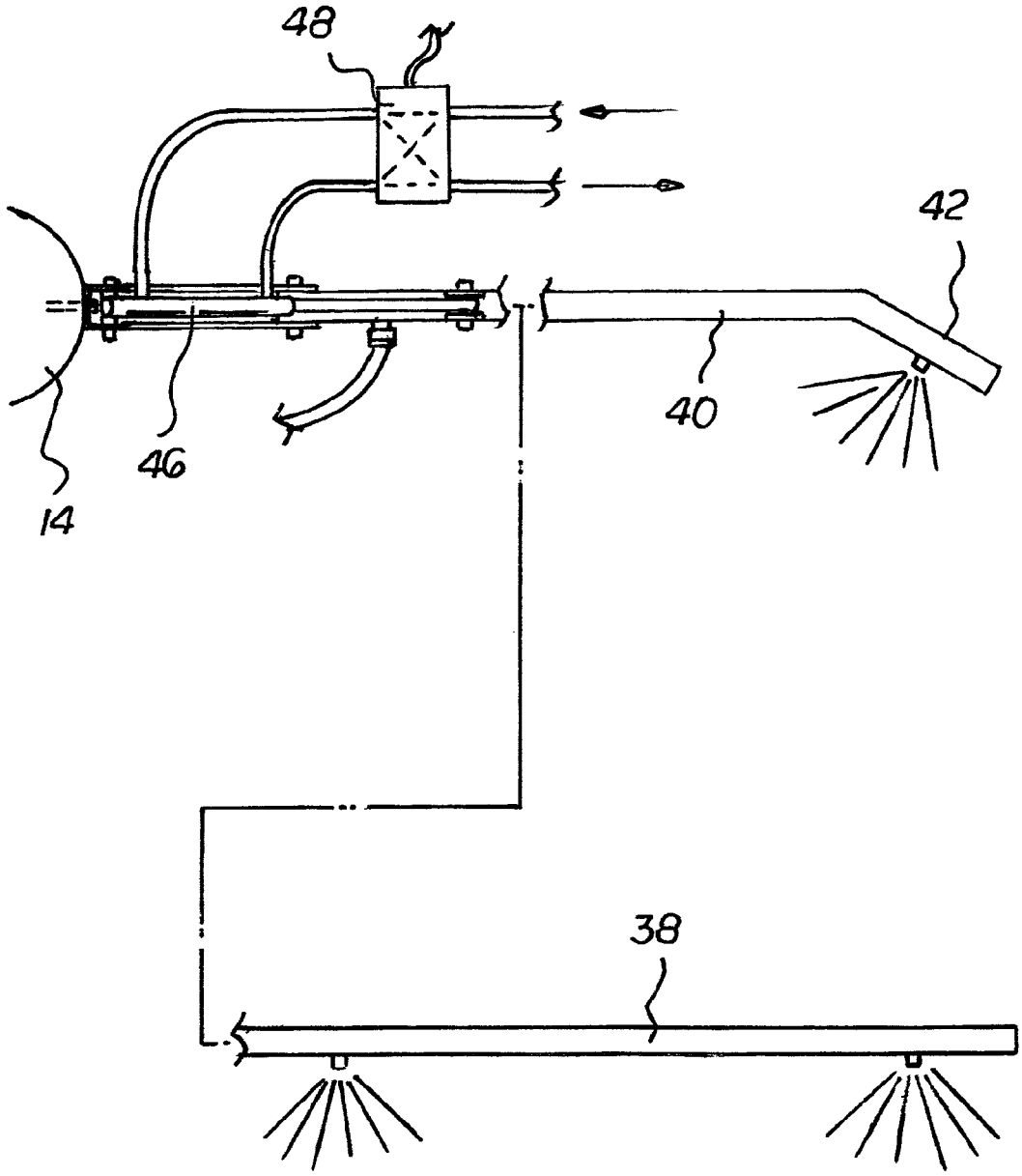
FIG. 5 is a cross sectional view taken along line 5-5 of FIG. 3.
Figure 6:
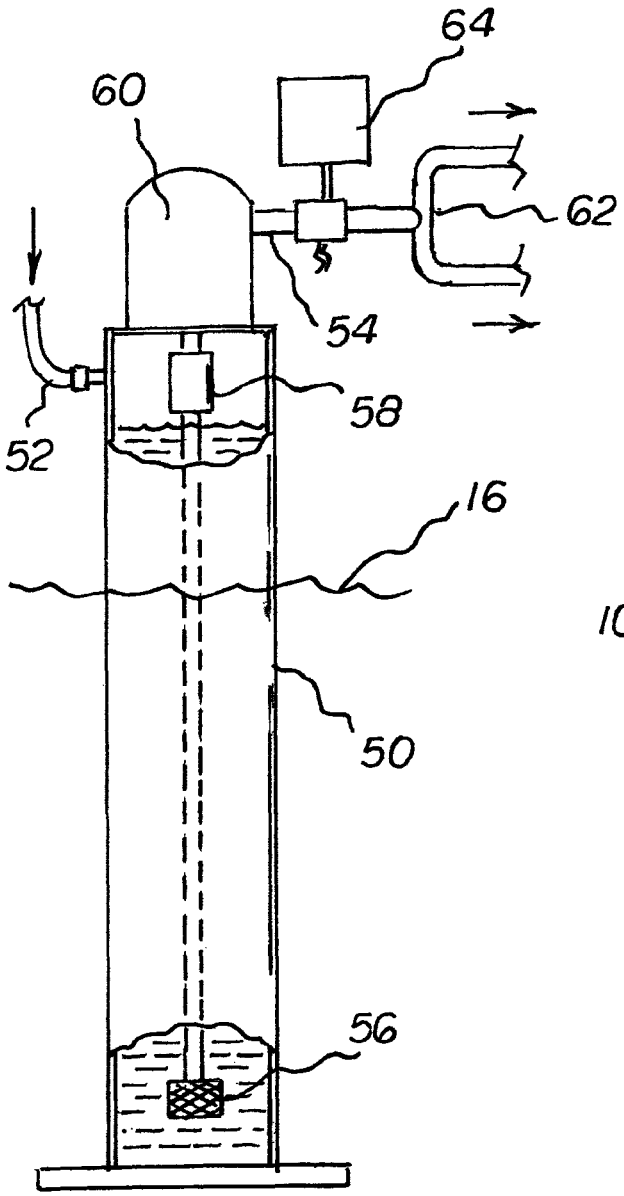
FIG. 6 is an enlarged side elevational view of the water tank and operational components shown in FIGS. 1 and 2.

With reference now to the drawings, and in particular to FIG. 1 thereof, the preferred embodiment of the new and improved boat wash/rinse system embodying the principles and concepts of the present invention and generally designated by the reference numeral 10 will be described.

The present invention, the boat wash/rinse system 10 is comprised of a plurality of components. Such components in their broadest context include a lift system, a driver, a plurality of spray heads, a water tank, and controls. Such components are individually configured and correlated with respect to each other so as to attain the desired objective.

First provided is a lift. The lift has pilings 14. The lift includes water with a waterline 16. A boat 18 with a central keel 20 is provided. The lift receives the boat. The lift has a first side and a second side. The lift also has a forward end, a rearward end, and an intermediate extent.

A cradle 24 is provided. The cradle has a horizontal base. The base has upstanding vertical supports 26. The vertical supports are positioned in contact with the boat on opposite sides of the keel. Drive cables 28 are provided. The drive cables are coupled to the horizontal base. In this manner the horizontal base, the vertical supports, and the boat are moved between a lowered orientation and a raised orientation. In the lowered orientation, the horizontal base and the vertical supports are beneath the waterline and beneath the boat. In the raised orientation, the horizontal base, the vertical supports, and the boat are provided above the waterline.

A plurality of fixed spray heads 32 is provided next. The fixed spray heads are fixedly secured to the pilings adjacent to the boat on each side of the lift. Each fixed spray head has an arcuate configuration. High pressure heads 34 are provided at each end. Low pressure heads 36 are provided intermediate the high pressure heads. The high and low pressure heads are adapted to spray the boat adjacent to the intermediate extent. A long spray arm 38 is provided. The long spray arm is pivotably coupled to and extends forwardly of each fixed spray head. Each long spray arm is in a linear configuration. The plurality of short end spray heads spray the boat adjacent to the forward end. A short spray arm 40 is provided. The short spray arm is pivotably coupled to and extends rearwardly of each fixed spray head. Each short arm has an inwardly extending bend 42. A plurality of long spray heads pray the boat adjacent to the rearward end.

Provided next is a hydraulic cylinder 46. The hydraulic cylinder is coupled to each long arm and to each short arm. In this manner the long arms and the short arms are pivoted between raised inoperative positions and lowered operative positions. A reversing valve 48 is provided. The reversing valve is coupled to each hydraulic cylinder. In this manner the long arms and the short arms are pivoted between the raised inoperative positions and the lowered inoperative positions.

Further provided is a water tank 50. The water tank is positioned at the lift adjacent to the first side. The water tank has a water inlet 52. The water tank has a water outlet 54. The water tank has an interior. The interior has a water filter 56. The interior also has a one way valve 58. The water tank has a pump 60. The pump feeds water from the water tank, to the fixed spray heads, and to the long arms and to the short arms. A splitter 62 is provided. The splitter directs the water from the pump to the spray heads at the first and second sides of the lift. A soap injector 64 is provided. The soap injector is provided intermediate the pump and the splitter. The various water lines are preferably removably attached to each other through quick connect couplings.

Provided last are controls. The controls are provided at the lift piling adjacent to the first side. The controls include a driver 68. The driver raises and lowers the boat in a cycle of operation. The controls also include an upper optical sensor 70. The controls further include a lower optical sensor 72. The lower optical sensor is adapted to activate the pump and the soap dispenser. In this manner the washing of the boat is initiated as it is lowered during a first cycle. The upper optical sensor is adapted to inactivate the soap dispenser. In this manner the boat is rinses as, it is raised and lowered during a second cycle.

Figure 7:
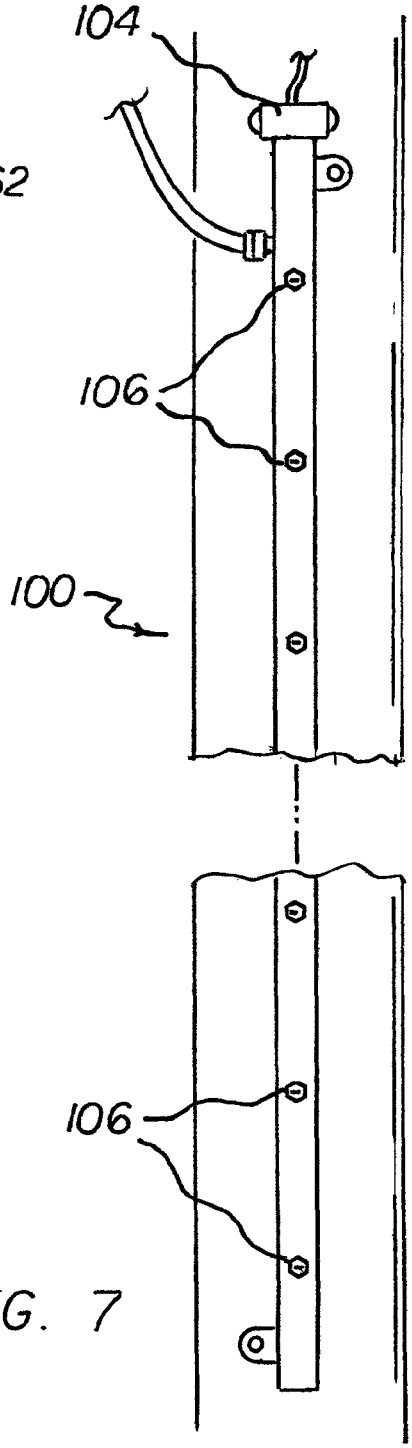
FIG. 7 is a front elevational view of fixed spray heads for cleaning larger boats in accordance with an alternate embodiment of the invention.

In an alternate embodiment of the system 100, the boat is moved horizontally while being washed. The system includes a single optical sensor 104. The system further includes a plurality of vertically aligned spray heads 106. Note FIG. 7.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A boat wash/rinse system comprising:

a lift for receiving a boat to be washed, the lift having forward end and a rearward end and an intermediate extent, the lift also having a first side with lift pilings and a second side with lift pilings;

a plurality of spray heads on each side of the dock, the spray heads including fixed spray heads in an arcuate configuration with high pressure heads at each end and with low pressure heads intermediate the high pressure heads, the high and low pressure heads adapted to spray the boat adjacent to the intermediate extents;

a water tank having a pump for feeding water from the water tank to the spray heads; and controls at the lift pilings adjacent to the first side, the controls including a driver to move the boat from between a first position and a second position, the controls also including an optical sensor to sense the presence of the boat to be washed, the optical sensor adapted to activate and inactivate the pump for the washing of the boat as it moved.

2. The system as set forth in claim 1 and further including:

a short spray arm pivotably coupled to and extending rearwardly of each fixed spray head, each short spray arm having an inwardly extending bend for spraying the boat adjacent to the rearward end.

3. The system as set forth in claim 2 and further including:

a long spray arm pivotably coupled to and extending forwardly of each fixed spray head, each long spray arm having a linear configuration with plural end spray heads for spraying the boat adjacent to the forward end.

4. A boat wash/rinse system (10) for washing and rinsing a boat while the boat is being raised and lowered, the washing and rinsing and the raising and lowering being done in a safe, ecological, convenient and economical manner, the system comprising, in combination:

a lift with pilings (14), the lift including water with a waterline (16) for receiving boat (18) with a central keel (20), the lift having a first side and a second side, the lift also having a forward end and a rearward end and an intermediate extent;

an elevator (24) formed of a horizontal base (26) with upstanding vertical supports (26), the vertical supports positioned in contact with the boat on opposite sides of the keel, drive cables (28) coupled to the horizontal base for moving the horizontal base and the vertical supports and the boat between a lowered orientation and a raised orientation, the lowered orientation being with the horizontal base and the vertical supports beneath the waterline and beneath the boat, the raised orientation being with the horizontal base and the vertical supports and the boat above the waterline;

a plurality of fixed spray heads (32) fixedly secured to the pilings adjacent to the boat on each side of the lift, each fixed spray head having an arcuate configuration with high pressure heads (34) at each end and with low pressure heads (36) intermediate the high pressure heads, the high and low pressure heads adapted to spray the boat adjacent to the intermediate extent, a long spray arm (38) pivotably coupled to and extending forwardly of each fixed spray head, each long spray arm having a linear configuration with plural snort end spray heads for spraying the boat adjacent to the forward end, a short spray arm 40 pivotably coupled to and extending rearwardly of each fixed spray head, each short arm having an inwardly extending bend (42) with a plurality of long spray heads for spraying the boat adjacent to the rearward end;

a hydraulic cylinder (46) coupled to each long arm and to each short arm for pivoting the long arms and the short arms between raised inoperative positions and lowered operative positions, a reversing valve (48) coupled to each hydraulic cylinder for pivoting the long arms and the short arms between the raised inoperative positions and the lowered operative positions;

a water tank (50) positioned at the dock adjacent to the first side, the water tank having a water inlet (52) and a water outlet (54), the water tank having an interior with a water filter (56) and a one way valve (58), the water tank having a pump (60) for feeding water from the water tank to the fixed spray heads and to the long arms and to the short arms, a splitter (62) for directing the water from the pump to the spray heads at the first and second sides of the lift, a soap injector (64) intermediate the pump and the splitter;

controls at the lift adjacent to the first side, the controls including a driver (68) to raise and lower the boat in a cycle of operation, the controls also including an upper optical sensor (70) and a lower optical sensor (72), the lower optical sensor adapted to activate the pump and the soap dispenser for initiating the washing of the boat as it is lowered during a first cycle, the upper optical sensor adapted to inactivate the soap dispenser for rinsing of the boat as it is raised and lowered during a second cycle.

* * * * *